US006010235A

United States Patent [19]

Sawyer

[11] Patent Number: 6,010,235

[45] Date of Patent: Jan. 4, 2000

[54] DECORATION FOR LAMP SHADES

[76] Inventor: Gerald Sawyer, 580 Barrow Park Dr., Winder, Ga. 30680

[21] Appl. No.: 09/058,465

[22] Filed: Apr. 10, 1998

[51] Int. Cl.[7] ..... A47G 1/17

[52] U.S. Cl. ..... 362/351; 362/398; 362/311; 362/806; 248/206.5

[58] Field of Search ..... 362/351, 398, 362/806, 311; 248/683, 206.5

[56] References Cited

U.S. PATENT DOCUMENTS

| | | | |
|---|---|---|---|
| 4,163,998 | 8/1979 | Anderson et al. | 362/358 |
| 4,344,115 | 8/1982 | Pickens et al. | 362/216 |
| 5,746,329 | 5/1998 | Rondeau | 211/123 |
| 5,833,349 | 11/1998 | Apple | 362/84 |
| 5,895,018 | 4/1999 | Rielo | 248/206.5 |

*Primary Examiner*—Thomas M. Sember

*Attorney, Agent, or Firm*—James B. Middleton; Walter A. Rodgers

[57] ABSTRACT

A decoration for a lamp shade is in the form of a sculptured work that is visible when the lamp is turned off, and, when the lamp is turned on, the decoration shows in profile, the decoration having a pleasing appearance both as a sculptural work and as a profile. The decoration has a ferromagnetic member as a part of the decoration, and a permanent magnet is attracted to the plate. The magnet may be placed inside the lamp shade to fix the decoration to the shade outside of the shade, or the magnet may be on the outside, and attracted to a wire of the shade. The decoration may be used singly or in multiples. One version is stamped from brass sheet, with a plate soldered on, then the decoration provided with a finish such as antiquing or gold plating.

12 Claims, 1 Drawing Sheet

DECORATION FOR LAMP SHADES

BACKGROUND OF THE INVENTION

1. Field of the Invention

This invention relates generally to lamp shades and the like, and is more particularly concerned with a decoration that is easy to apply to a lamp shade and to remove therefrom, the decoration being aesthetically pleasing whether the lamp is on or off.

1. Discussion of the Prior Art

There are many different forms of lamp shades, concerning both the overall shape and decorations carried by the shade. The prior art decorations have usually been in the form of cords and the like used to trim the shade, ruffles made of fabric, paper or the like, and ribbons, with or without bows. All these decorations are most often added to the shade at the time of manufacture; and, though such decorations may be added after the shade has been manufactured, they are added with difficulty, and are not easily removed. Thus, a shade has one appearance, and that appearance is generally not changed.

The prior art decorations, whether cords, ribbons, ruffles or the like, are designed to be appreciated when the lamp is off and the lamp is lighted externally. Under such conditions the ruffles and the like can be seen, and the shape and color appreciated. When the lamp is lighted, however, the decorations are simply in profile and are generally not particularly attractive.

Thus, the prior art has not provided an easily applied decoration that is aesthetically pleasing both when the lamp is off and when the lamp is on.

SUMMARY OF THE INVENTION

The present invention provides a decoration for a lamp shade or the like, the decoration having an aesthetically pleasing shape to be attractive in profile, and preferably sculpted or otherwise shaped to be attractive when fully lighted externally. The decoration is provided with a plate of a ferromagnetic material, and a magnet. The magnet may be placed on the inside of the lamp shade while the decoration is on the outside of the lamp shade, or both magnet and decoration may be placed on the outside of the shade with the magnet adhered to a metal part of the shade itself. Since magnetic attraction is the only force holding the decoration in place it will be understood that the decoration can be easily installed, removed, and relocated on the lamp shade.

The decoration of the present invention may be made of brass, wood, porcelain, polymeric materials or the like, so the decoration is not necessarily ferromagnetic. For such a device, a ferromagnetic plate is soldered or otherwise fixed to the decoration so the magnet will be attracted to the decoration. It will be understood that the invention also contemplates decorations made of other materials, both ferromagnetic non-ferromagnetic, and having other finishes, depending on the particular aesthetic design.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
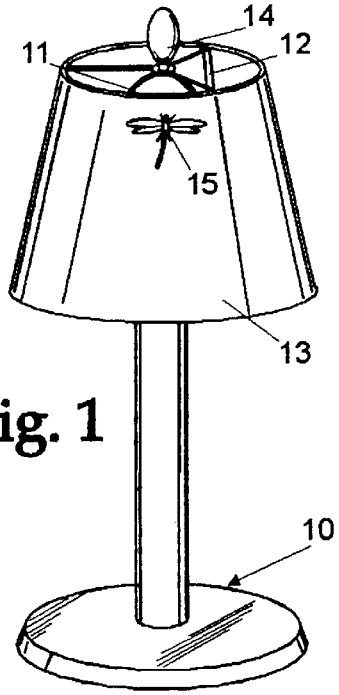
FIG. 1 is a perspective view of a lamp and lamp shade having a decoration made in accordance with the present invention on the lamp shade.

Referring now more particularly to the drawings, and to that embodiment of the invention here presented by way of illustration, FIG. 1 shows a lamp 10 having a shade carried by a harp 11. The shade typically has top and bottom wires, and a plurality of side wires 12 to provide shape to the shade. The fabric 13 covers the wires and is supported by the wires. A finial 14 secures the shade to the harp 11. The shade fabric as here shown is very plain, and may be made of cloth, paper, plastic or other materials, preferably of translucent or transparent material. Those skilled in the art will understand, however, that a highly decorative shade can also be used so long as there is at least one area for receiving the decoration of the present invention.

The shade is here shown as carrying a decoration 15, the decoration 15 being in the general form of a dragonfly. The decoration, or dragonfly 15, as shown in FIG. 1, is sculpted to be aesthetically pleasing, though the sculpture may be in realistic detail, somewhat stylized, or completely abstract. The only requirement is that the sculpture be aesthetically pleasing.

Figure 2:
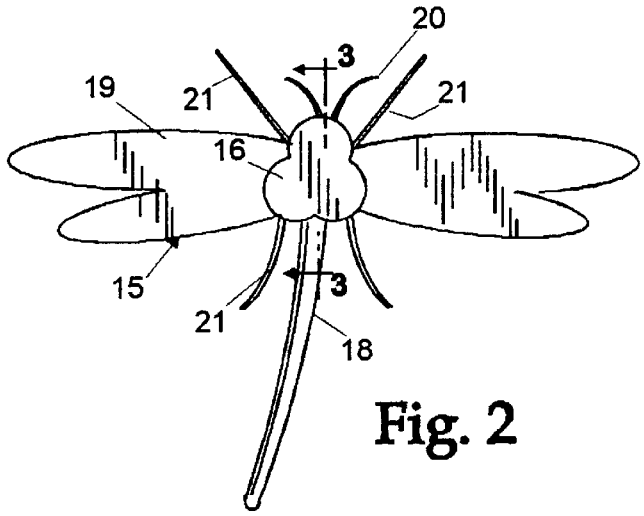
FIG. 2 is an enlarged bottom plan view of the decoration shown in FIG. 1.

Attention is directed to FIG. 2 of the drawings, which shows the bottom plan view of the dragonfly illustrated in FIG. 1. The dragonfly 15 is sculpted with the usual head, thorax and abdomen, but the head and thorax are not seen in FIG. 1. The head and thorax are covered by a plate 16, and the abdomen 18 extends beyond the plate 16. The wings 19 extend laterally from under the plate 16, the wings being attached to the thorax. Also, there are antennae 20 and legs 21.

Figure 3:
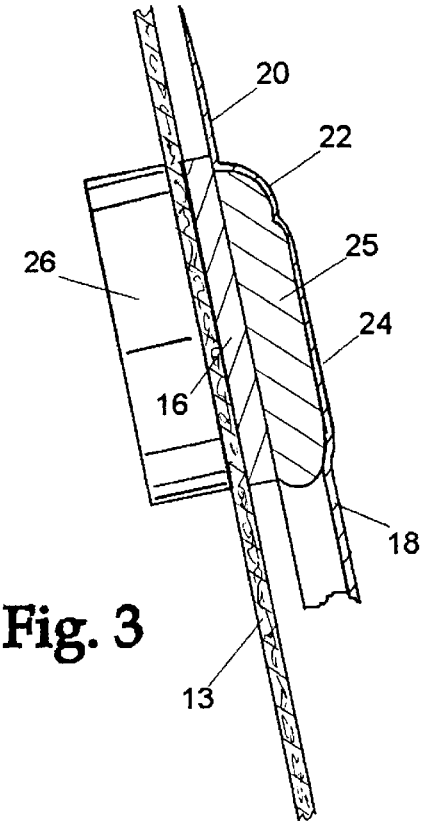
FIG. 3 is an enlarged cross-sectional view taken along the line 3—3 in FIG. 2; and, FIG. 4 is a view similar to FIG. 3 but showing the magnet on the outside of the shade.

Looking at FIG. 3 in conjunction with FIG. 2, the construction of the device of the present invention will be understood. Many designs are available in stamped brass, the designs being stamped from sheet stock to yield a three dimensional, sculpted form. The outside of the piece is given a shape to resemble the desired thing, whether insect, leaf, flower, ornate cross or other shape; however, the inside is hollow. In FIG. 3 it will be seen that the outside, or dorsal side of the dragonfly, is shaped as the head 22, thorax 24 and abdomen 18. In order to attach a plate such as the plate 16, the inside of the piece is filled with solder 25, the solder being adhered to both the stamped piece and the plate 16.

Though a dragonfly has been here shown by way of illustration, and the dragonfly has a hollow cavity as shown in FIG. 3, it will be understood by those skilled in the art that other pieces may not have such a cavity. For example, a leaf would be quite flat, even after stamping, and a plate 16 could be soldered to the leaf shape with a small layer of solder.

After the plate 16 has been attached to the dragonfly or other shape, the entire piece will be finished. The finishing may be plating in gold or other metals, both precious and non-precious, simply lacquering, painting, antiquing or other conventional finishing processes. Using the brass stamping as described above, one finish that has been used is to plate the entire piece with gold. Another finish is to react the brass so it is dark, then polish the parts in relief, so the piece has an antique appearance. A decoration made of wood can be stained and varnished as is well known.

With the completed decoration, the decoration 15 can be placed on a lamp shade wherever desired, and a magnet 26 positioned adjacent to the plate 16, on the opposite side of the fabric 13. The magnetic attraction of the magnet 26 to the ferromagnetic plate 16 will easily hold the decoration 15 in place until it is intentionally moved.

Figure 4:
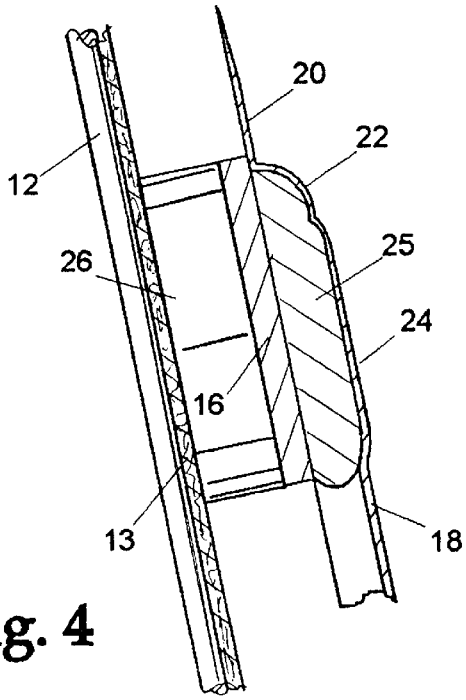

Looking at FIG. 4 of the drawings, an alternative attachment to the shade is illustrated. In FIG. 4, the magnet 26 is fixed directly to the plate 16, and both the magnet and the decoration 15 are on the outside of the shade. The magnet 26 is then placed adjacent to one of the side wires 12, or a top or bottom wire. This is an effective means for using the device of the present invention, though of course the locations for the decorations are limited.

With the decoration 15 fixed to the lamp shade, when the device is externally lighted, the beauty of the decoration 15 will show somewhat as a jewel on the lampshade. On the other hand, when the lamp 10 is lighted, the decoration 15 will be back-lighted, so it will be seen mostly in profile, appearing as a pleasing shape on the shade. Thus, whether the lamp is on or off, the decoration of the present invention will be aesthetically pleasing. The decoration is very easy to apply, to remove, and to relocate on the shade, so different designs, or groups of designs, can be utilized as desired for the season, the decor, the particular party or the like.

It will therefore be understood by those skilled in the art that the particular embodiment of the invention here chosen is by way of illustration only, and is meant to be in no way restrictive; therefore, numerous changes and modifications may be made, and the full use of equivalents resorted to, without departing from the spirit or scope of the invention as outlined in the appended claims.

What is claimed as invention is:

1. In combination, a lamp including a shade and a light bulb, said shade including an inside and an outside, said shade at least partially covering said light bulb and being at least translucent, a decoration fixed to said shade, said decoration comprising a generally opaque sculptural work having an aesthetically pleasing profile and being placed on said outside of said shade from said light bulb so that said decoration is visible as a sculptural work when said lamp is not lighted, said decoration being visible in profile when said lamp is lighted, said decoration including a ferromagnetic member, and a permanent magnet attracted to said ferromagnetic member for suporting said decoration on said shade.

2. The combination as claimed in claim 1, wherein said permanent magnet is on said inside of said shade adjacent to said ferromagnetic member, and said shade comprises fabric with said fabric of said shade between said permanent magnet and said ferromagnetic member.

3. The combination as claimed in claim 1, wherein said permanent magnet is adhered to said ferromagnetic member, and said permanent magnet is adjacent to a wire in said shade and is attracted thereto for holding said decoration on said shade.

4. The combination as claimed in claim 1, wherein said decoration is formed of a non-ferromagnetic material, and further including a ferromagnetic plate fixed to said decoration.

5. The combination as claimed in claim 1, wherein said decoration is formed of a non-ferromagnetic material, and further including a ferromagnetic plate fixed to said decoration.

6. The combination as claimed in claim 5, and further including a plating of a metal covering said decoration in its entirety.

7. The combination as claimed in claim 5, wherein said non-ferromagnetic material is brass, and said plating of a metal is gold.

8. The combination as claimed in claim 5, wherein said non-ferromagnetic material is finished by antiquing.

9. A decoration for a lamp shade, said decoration comprising a sculptural work stamped from sheet metal, a ferromagnetic plate fixed to said sculptural work, a permanent magnet attracted to said ferromagnetic plate for fixing said decoration to said lamp shade, said sculptural work defining a cavity therein and including a quantity of solder within said cavity and adhered to said sculptural work, and said ferromagnetic plate being adhered to said quantity of solder.

10. A decoration for a lamp shade as claimed in claim 9, and including a finish on said sheet metal.

11. A decoration for a lamp shade as claimed in claim 9, and further including a plating of metal covering said decoration in its entirety.

12. A decoration for a lamp shade as claimed in claim 11, wherein said plating of metal comprises gold.

* * * * *